US009520682B2

(12) United States Patent
Chang et al.

(10) Patent No.: US 9,520,682 B2
(45) Date of Patent: Dec. 13, 2016

(54) SHIELDING ELECTRICAL CONNECTOR AND METHOD OF MAKING THE SAME

(71) Applicant: HON HAI PRECISION INDUSTRY CO., LTD., New Taipei (TW)

(72) Inventors: Yen-Chih Chang, New Taipei (TW); Tzu-Yao Hwang, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 187 days.

(21) Appl. No.: 14/287,074

(22) Filed: May 26, 2014

(65) Prior Publication Data

US 2014/0357121 A1 Dec. 4, 2014

(30) Foreign Application Priority Data

May 30, 2013 (TW) ..... 102119036 A

(51) Int. Cl.

| | |
|---|---|
| ***H01R 13/648*** | (2006.01) |
| ***H01R 13/6585*** | (2011.01) |
| ***H01R 43/16*** | (2006.01) |
| ***H01R 43/24*** | (2006.01) |

(52) U.S. Cl.

CPC ..... *H01R 13/6585* (2013.01); *H01R 43/16* (2013.01); *H01R 43/24* (2013.01); *Y10T 29/49151* (2015.01)

(58) Field of Classification Search

CPC ..... H01R 13/648; H01R 13/6581; H01R 13/6587; H01R 13/504; H01R 13/5845; H01R 43/04

USPC ..... 439/607.01, 607.09, 607.58; 29/844

See application file for complete search history.

(56) References Cited

U.S. PATENT DOCUMENTS

| | | | | |
|---|---|---|---|---|
| 9,048,591 | B2 * | 6/2015 | Chang | H01R 13/6597 |
| 2012/0028501 | A1 * | 2/2012 | Cheng | H01R 13/6594 439/607.58 |
| 2014/0179160 | A1 * | 6/2014 | Hwang | H01R 43/24 439/607.13 |

FOREIGN PATENT DOCUMENTS

| | | |
|---|---|---|
| CN | 100440627 | 12/2008 |
| CN | 101501937 A | 8/2009 |
| CN | 101515696 A | 8/2009 |
| CN | 103117486 A | 5/2013 |
| JP | 2009193883 A | 8/2009 |
| TW | M419248 | 12/2011 |
| TW | M453277 | 5/2013 |

* cited by examiner

*Primary Examiner* — Hae Moon Hyeon

(74) *Attorney, Agent, or Firm* — Wei Te Chung; Ming Chieh Chang

(57) ABSTRACT

An electrical connector electrically for connecting a chip module having a contacting surface to a printed circuit board includes an insulative housing, a number of terminals received therein and a number of shielding plates received in the insulative housing and located around the terminals. The insulative housing is insert molded with the shielding plates and the terminals and includes a plurality of through slots. The terminals are formed by separated from the shielding plates by the through slot.

13 Claims, 7 Drawing Sheets

SHIELDING ELECTRICAL CONNECTOR AND METHOD OF MAKING THE SAME

BACKGROUND OF THE INVENTION

1. Field of the Invention

The present invention relates to an electrical connector, and more particularly to an electrical connector mounted to a printed circuit board for receiving an Integrated Circuit package.

2. Description of the Prior Art

As the "Nonlinear Analysis Helps Design LGA (Land Grid Array) Connectors" (Connector Specifier, February 2001) show, an electrical connector includes a base and a number of contacts assembled in the base. Each of the contacts defines an upper contacting point for contacting with a CPU (Central Processing Unit) and a lower contacting point for contacting with a printed circuit board, and it forms the signal transmission between the CPU and the printed circuit board. With the development of the electronic technology, the size of the electrical connector becomes smaller and smaller, and the density of the pads of the CPU and the density of the pads of the printed circuit board become larger and larger. So, the electromagnetic interference between the adjacent contacts becomes serious and it affects the quality of the signal transmission between the CPU and the printed circuit board.

An electrical connector electically connecting a chip module to a printed circuit board is described in Tai Wan Patent No. M419,248, issued to CHANG et al. on Dec. 21, 2011. The electrical connector includes a socket body with a plurality of electrical contacts secured therein. The socket body has a top surface, a low surface opposite to the top surface and a number of grooves penetrating from the top surface to the low surface. Each of the grooves includes a first groove and a second groove. The contacts secured in the first grooves respectively. The electrical connector further includes a number of metal shielding plates assembled in the second grooves. However, as the contacts and the shielding plates are manufactured and then assembled in the socket body respectively, the manufacturing process of the electrical connector is complex and the manufacturing cost is relative high.

Therefore, it is needed to find a new electrical connector to overcome the problems mentioned above.

SUMMARY OF THE INVENTION

Accordingly, an object of the present invention is to provide an electrical connector having an improved shielding effect and reducing the cost and being easy to be manufactured.

In order to achieve the object set forth, an electrical connector electrically connecting a chip module having a contacting surface to a printed circuit board is provided. The electrical connector comprises an insulative housing, a plurality of terminals received therein and a plurality of shielding plates received in the insulative housing and located around the terminals. The insulative housing is insert-molded with the shielding plates and the terminals and includes a plurality of through slots. The terminals are formed by separated from the shielding plates by the through hole.

DESCRIPTION OF PREFERRED EMBODIMENT

Figure 1:
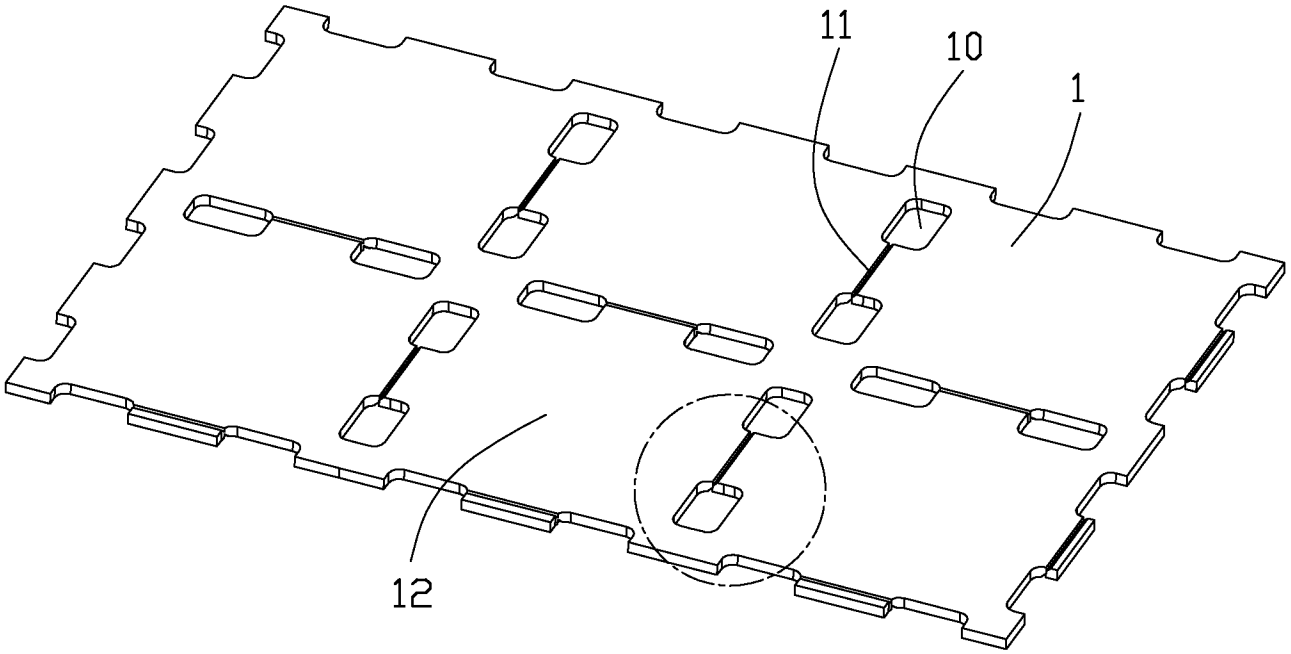
FIG. 1 is a perspective view of a metal plate before forming an electrical connector in accordance with a preferred embodiment of the present invention.
Figure 2:
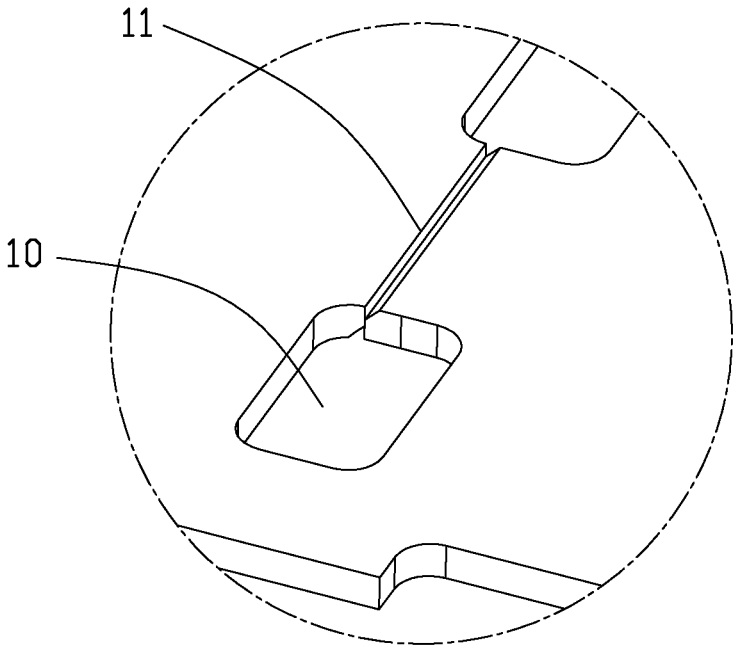
FIG. 2 is an enlarged view of the circular portion as shown in FIG. 1.
Figure 3:
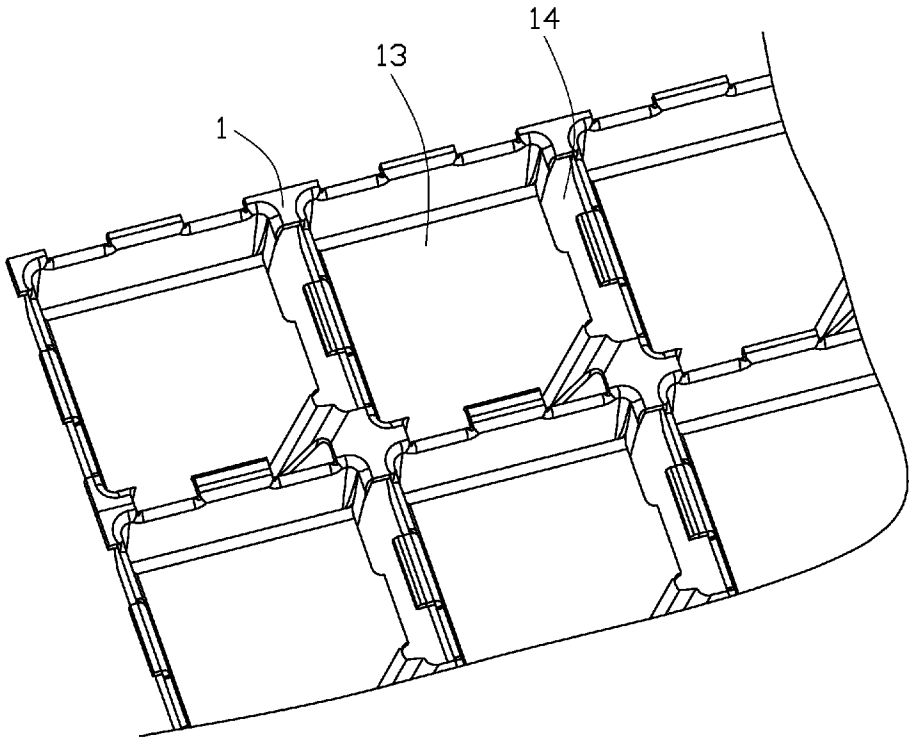
FIG. 3 is a partial perspective view of the metal plate configured with a cup shape by deep drawing the metal plate as shown in FIG. 1.
Figure 4:
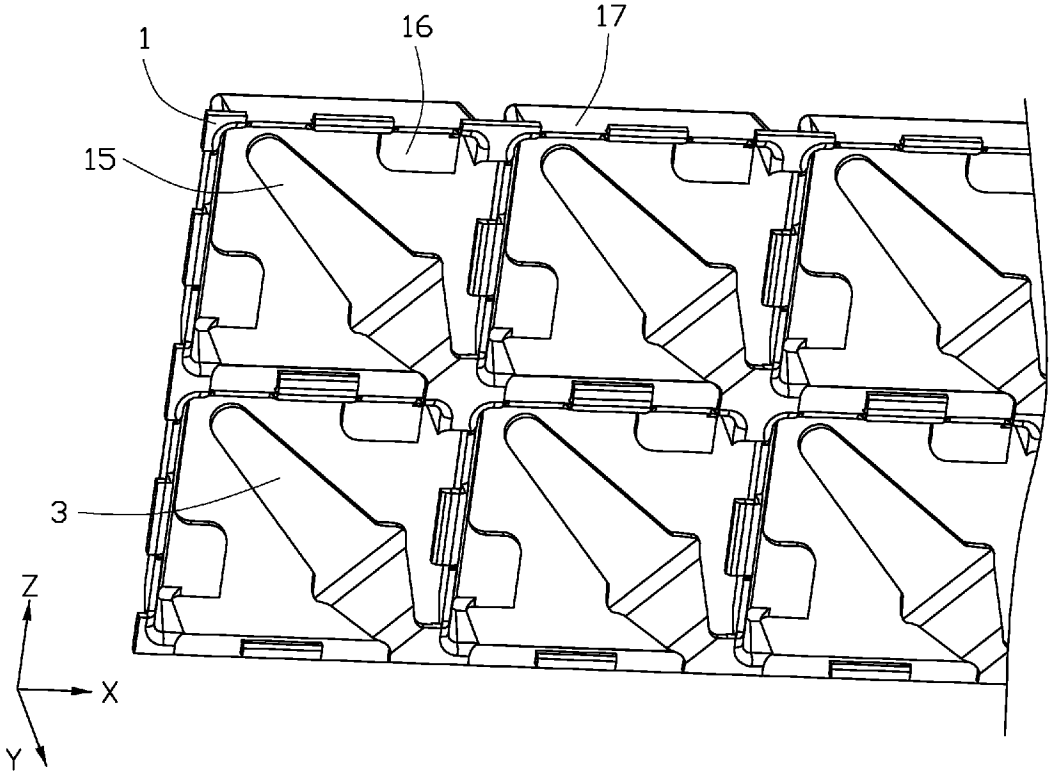
FIG. 4 is partial a perspective view of a plurality of spring beams and a plurality of shielding plates after blanking the metal plate in FIG. 3.
Figure 5:
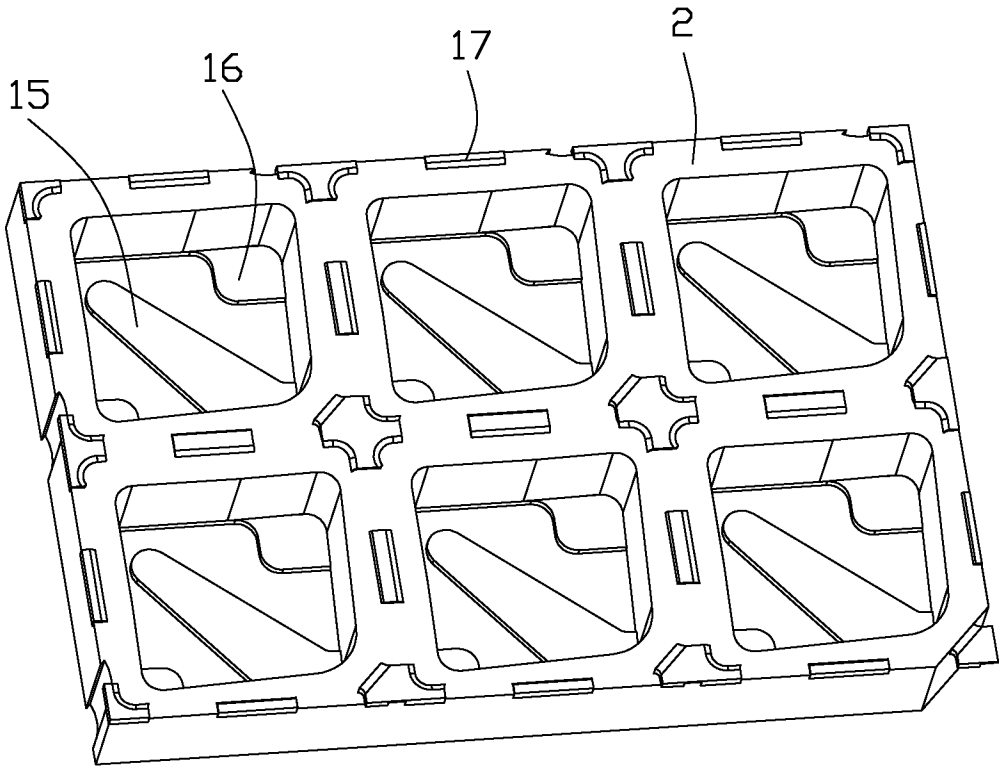
FIG. 5 is a perspective view of an insulative housing by using insert molding and coating on the spring beams and shielding plates as shown in FIG. 4.

Reference will now be made to the drawings to describe the present invention in detail.

Referring to FIGS. 1-4, an electrical connector 100 according to the present invention is used for electrically connecting a chip module having a plurality of contacting surfaces to a printed circuit board. The electrical connector 100 comprises an insulative housing 2, a plurality of terminals 3 received therein and a plurality of shielding plates 17 received in the insulative housing 2 and located around the terminals 3.

Referring to FIGS. 1-6, the manufacturing process of the electrical connector 100 will be described as following. Providing a planner metal plate 1, and blanking a plurality of holes 10 and making a plurality of V-cuts 11 at specified edge arranged in an array. The holes 10 are arranged in a matrix and the metal plate 1 forms a plurality of units 12. The V-cut 11 locates between the adjacent holes 10 for convenient the next deep drawing process. Using deep drawing process to make the metal plate 1 configured with a semi-closed cup shape by blanking the V-cut 11, and then forming a gap 14 from the adjacent sidewalls of the metal plate 1. Blanking a bottom surface 13 of the metal plate 1 and forming a plurality of spring beams 15 and shielding plates 17. The spring beam 15 locates between the adjacent sidewalls and the gap 14. The spring beam 15 is arranged along a diagonal direction. The bottom surface 13 forms a linking portion 16 connecting with the shielding plate 17. Providing an insulative housing 2 insert-molded with the spring beam 15 and the shielding plate 17. The spring beam 15 and the shielding plate 17 are embedded in the insulative housing 2, and at this time, the spring beam 15 connects the shielding plate 17. Providing a through slot 23 for punching and separating the spring beam 15 from the shielding plate 17, it forms a section (not labeled) and the section makes the terminal 3 and the shielding plate 17 both in communicate with the through slot 23. The terminal 3 is formed by bending the spring beam 15.

Figure 6:
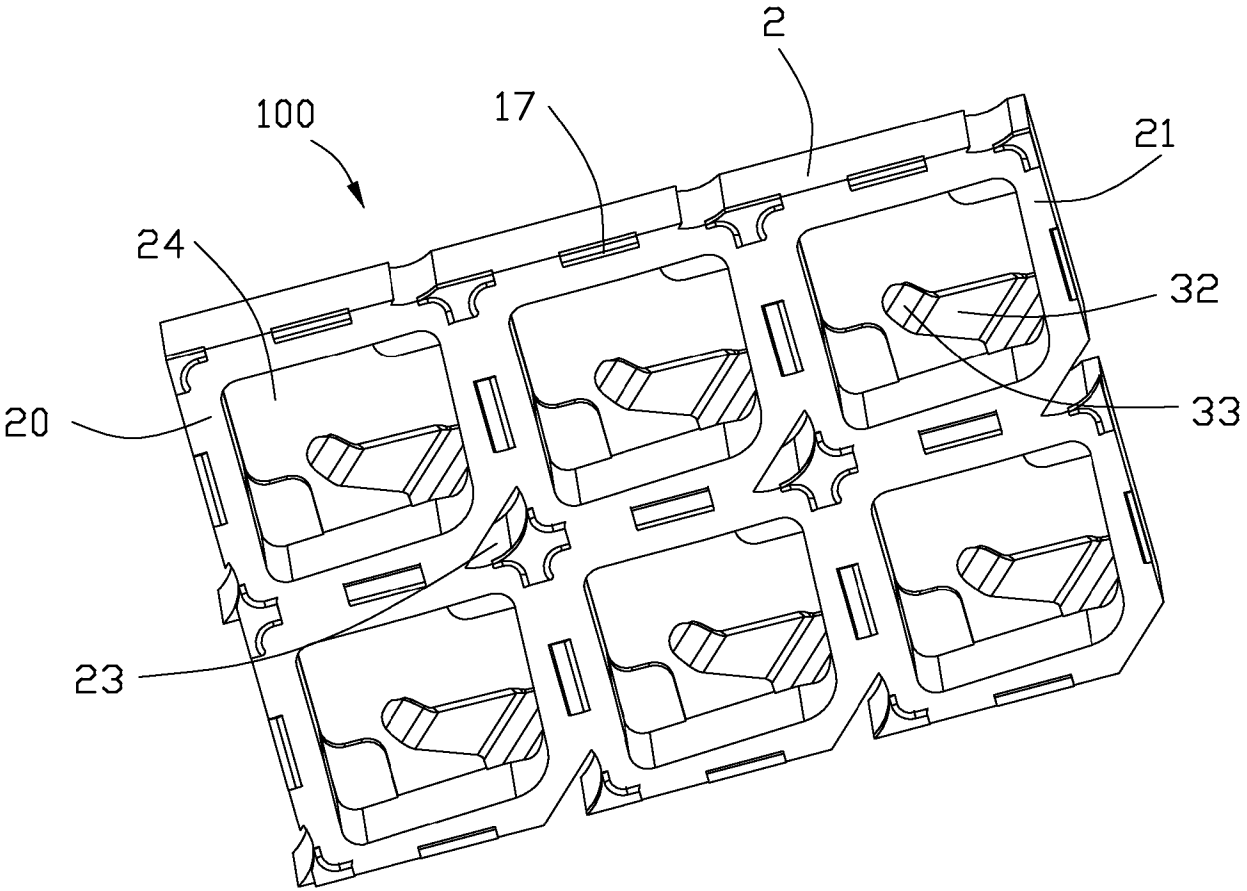
FIG. 6 is a perspective view of the electrical connector according to the preferred embodiment of the present invention shown in FIG. 5.
Figure 7:
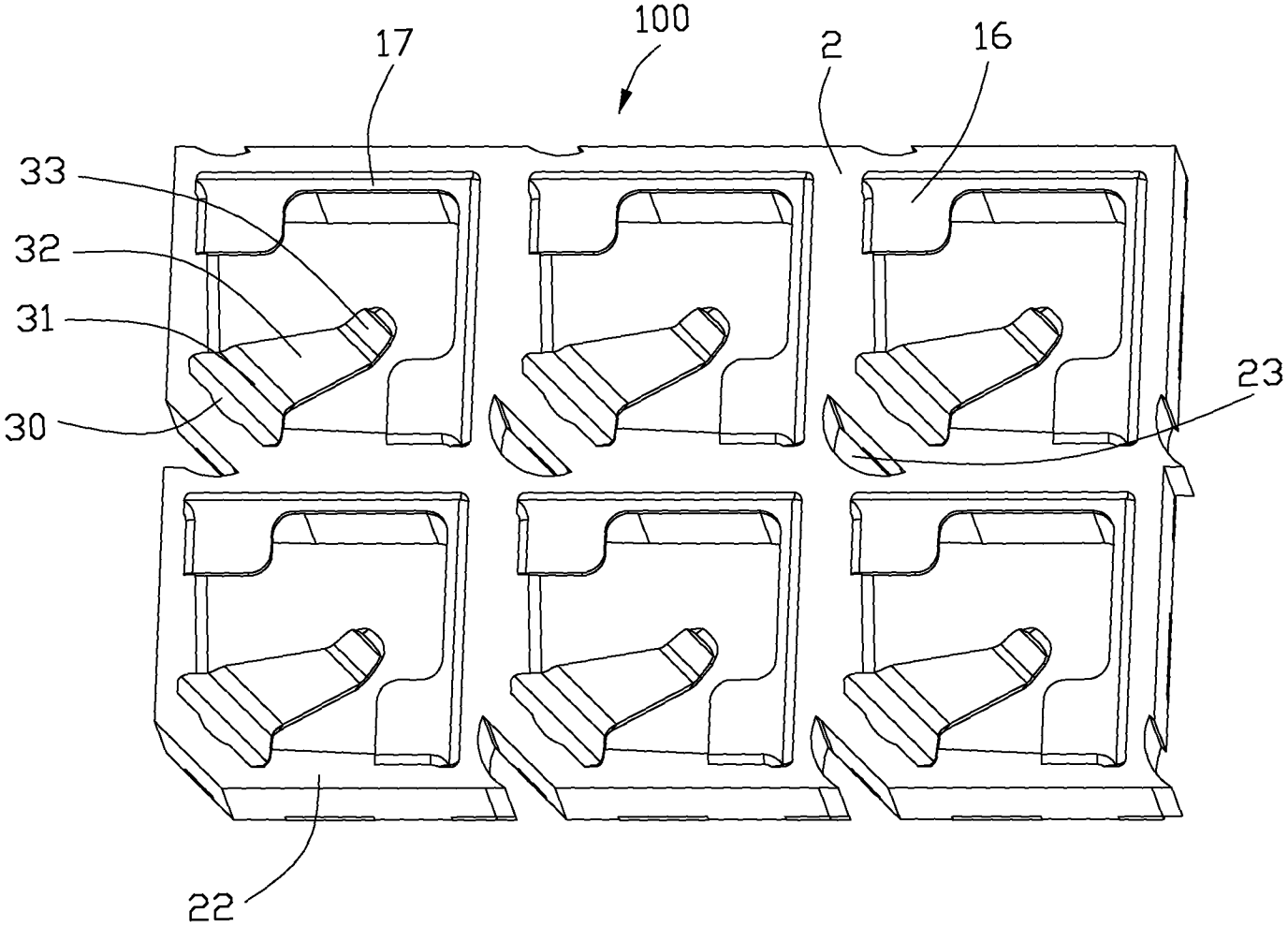
FIG. 7 is another perspective view of the electrical connector as shown in FIG. 6.

Referring to FIGS. 6-7, after the electrical connector 100 is formed, the terminal 3 comprises a base 30, a connecting portion 31 extending downwardly from the base 30, a spring portion 32 bending upwardly from the connecting portion 31 and extending toward a side of the base 30 and a contacting portion 33 bending and extending away from the base 30, the base 30 is embedded in the insulative housing 2 and the contacting portion 33 contacts with the chip module.

The insulative housing 2 comprises a body portion 20 configured with a grid structure arranged in a longitudinal direction (x) and a transverse direction (y) perpendicular to each other and the whole grid structure extending along a vertical direction (z) perpendicular to both said longitudinal direction and said transverse direction, the insulative housing 2 having an upper surface 21 and a lower surface 22 opposite to each other. The insulative housing 2 further comprises a plurality of receiving holes 24 surrounded by the body portions 20 and penetrating from the upper surface 21 to the lower surface 22. The shielding plate 17 is embedded in the body portion 20 and extends upwardly above the upper surface 21 at the intermediate position of the body portion 20 and the intersection position of the grid arrangement of the body portion 20, so they are exposed to the contacting surface. The through slot 23 locates at the intersection portion of the grid arrangement and passes through the shielding plate 17 from top to bottom. The linking portion 16 extends downwardly beyond the lower surface 22 and extends inwardly toward the receiving hole 24 for electrically connecting the printed circuit board.

According to the present invention, the terminal 3 and the shielding plate 17 are integrated with each other, the insulative housing 2 is insert molded with both of the terminal 3 and the shielding plate 17, the terminal 3 and the shielding plate 17 are separated by the through slot 23, thus, the process is simple and no need to provide a shielding element additionally, it is can save material and reduce the cost.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing;

a plurality of terminals received in the insulative housing; and a plurality of shielding plates received in the insulative housing and located around the terminals, wherein the shielding plates and the terminals are originally linked unitarily with each other and both insert molded within the insulative housing, and the terminals are separated from the shielding plates via a blanking process after the housing is molded.

2. The electrical connector as claimed in claim 1, wherein said insulative housing comprises a body portion configured with a grid arrangement, the body portion has an upper surface and a lower surface opposite to each other, the insulative housing further comprises a plurality of receiving holes surrounded by the body portion and penetrated from the upper surface to the lower surface.

3. The electrical connector as claimed in claim 2, wherein said shielding plate is embedded in the body portion and extends upwardly above the upper surface at the intermediate position of the body portion and the intersection position of the grid arrangement of the body portion for exposing to the contacting surface.

4. The electrical connector as claimed in claim 3, wherein the insulative housing comprises a plurality of through slots located at the intersection position of the grid arrangement and extending through the shielding plate from top to bottom.

5. The electrical connector as claimed in claim 1, wherein said terminal comprises a base, a connecting portion extending downwardly from the base, a spring portion bending upwardly from the connecting portion and extending toward a side of the base and a contacting portion bending and extending away from the base.

6. The electrical connector as claimed in claim 5, wherein said base is embedded in the insulative housing, the base and the shielding plate are unitarily formed with each other before separated by the through slot.

7. The electrical connector as claimed in claim 6, wherein the shielding plate comprises a linking portion extending downwardly beyond the lower surface and extending inwardly toward the receiving hole.

8. The electrical connector as claimed in claim 1, wherein the housing defines a plurality of through slots each in alignment with a joint between the corresponding terminal and the shielding plate during the insert molding process, and said join is successively removed to separate the terminal from the shielding plate.

9. An electrical connector comprising:

an insulative housing defining a grid structure arranged in a longitudinal direction and a transverse direction perpendicular to each other and the whole grid structure extending along a vertical direction perpendicular to both said longitudinal direction and said transverse direction;

a plurality of shielding plates being embedded within the grid structure;

a plurality of terminals disposed respectively in corresponding grid units defined by said grid structure; wherein the housing defines a plurality of through slots each in alignment with a joint, which is unitarily formed between the corresponding terminal and the corresponding shielding plate, along the vertical direction after an insert molding process to have the terminals and the shielding plate insert molded within the housing, and said joint is successively removed to separate the terminal from the shielding plate via a blanking process in said through slot.

10. The electrical connector as claimed in claim 9, wherein each of said shielding plates is extended in said vertical direction via a deep drawing process.

11. The electrical connector as claimed in claim 9, wherein the for each grid unit, the shielding plates only shield two neighboring sides, and the remaining two other neighboring sides are shielded by the shielding plates of the two neighboring grid units, respectively.

12. The electrical connector as claimed in claim 9, wherein said shielding plates and said terminals are originally formed unitarily on one sheet metal with a plurality of through holes corresponding to the grid structure for a successive deep drawing process to implement the shielding plates and the terminals in the vertical direction.

13. The electrical connector as claimed in claim 12, wherein the terminal essentially extends from one corner of each grid unit, and a pair of grounding pads unitarily extend respectively from the corresponding shielding plates around the two neighboring corners in said grid unit.

* * * * *